US011254121B2

(12) United States Patent
Hara

(10) Patent No.: US 11,254,121 B2
(45) Date of Patent: Feb. 22, 2022

(54) INKJET RECORDING APPARATUS FOR HEATING INTERNAL SPACE OF A TRANSFER BODY

(71) Applicant: KONICA MINOLTA, INC., Tokyo (JP)

(72) Inventor: Takahiro Hara, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 137 days.

(21) Appl. No.: 16/663,571

(22) Filed: Oct. 25, 2019

(65) Prior Publication Data

US 2020/0130350 A1 Apr. 30, 2020

(30) Foreign Application Priority Data

Oct. 31, 2018 (JP) ..... JP2018-204600

(51) Int. Cl.

| | |
|---|---|
| ***B41J 2/005*** | (2006.01) |
| ***B41J 11/00*** | (2006.01) |
| *B41J 2/01* | (2006.01) |
| *B41J 2/165* | (2006.01) |

(52) U.S. Cl.

CPC ..... *B41J 2/0057* (2013.01); *B41J 11/0022* (2021.01); *B41J 11/00222* (2021.01); *B41J 2/01* (2013.01); *B41J 11/002* (2013.01); *B41J 11/0015* (2013.01); *B41J 11/00224* (2021.01); *B41J 2002/012* (2013.01); *B41J 2002/16591* (2013.01)

(58) Field of Classification Search

CPC ..... B41J 2/0057; B41J 2002/012; B41J 11/0022; B41J 11/00222; B41J 11/00224; B41J 11/002; B41J 2/01; B41J 11/0015; B41J 2002/16591

See application file for complete search history.

(56) References Cited

U.S. PATENT DOCUMENTS

| | | | | |
|---|---|---|---|---|
| 7,725,050 | B2 * | 5/2010 | Li | B41J 29/377 399/96 |
| 2009/0295898 | A1 * | 12/2009 | Takatsuka | B41J 11/0015 347/104 |
| 2010/0073410 | A1 * | 3/2010 | Yui | B41J 11/0024 347/6 |
| 2013/0335476 | A1 * | 12/2013 | Ramesh | B41J 2/0057 347/17 |
| 2014/0056626 | A1 * | 2/2014 | Sakai | G03G 15/2017 399/329 |
| 2018/0086107 | A1 * | 3/2018 | Allison | F26B 3/20 |

FOREIGN PATENT DOCUMENTS

| | | |
|---|---|---|
| JP | 2011152803 A | 8/2011 |

* cited by examiner

*Primary Examiner* — Henok D Legesse

(74) *Attorney, Agent, or Firm* — Buchanan Ingersoll & Rooney PC

(57) ABSTRACT

An inkjet recording apparatus includes an ink jetter that jets ink and a transfer unit that has a ring-shaped intermediate transfer body. The transfer unit transfers, to a recording medium, a primary image formed on an outer circumferential surface of the intermediate transfer body with the ink that is jetted to land on the outer circumferential surface by the ink jetter. The transfer unit includes a heater that heats air in an internal space of the intermediate transfer body enclosed by an inner circumferential surface of the intermediate transfer body, and an air mover that flows the air in the internal space.

14 Claims, 7 Drawing Sheets

FIG. 8

| | WARM-UP OPERATION | IMAGE RECORDING OPERATION |
|---|---|---|
| CIRCLING SPEED OF INTERMEDIATE TRANSFER BELT [mm/sec] | 200 | 800 |
| SPEED OF AIR FLOW IN INTERNAL SPACE [mm/sec] | 400 | 200 |
| RELATIVE SPEED [mm/sec] | 600 | 1000 |

FIG. 9

| IMAGE COVERAGE [%] | ADJUSTMENT OF SPEED OF AIR FLOW [%] | TEMPERATURE OF HEATER [℃] |
|---|---|---|
| 50% < IMAGE COVERAGE | -20 | 49 |
| 10% < IMAGE COVERAGE ≤ 50% | 0 | 50 |
| IMAGE COVERAGE ≤ 10% | +20 | 51 |

INKJET RECORDING APPARATUS FOR HEATING INTERNAL SPACE OF A TRANSFER BODY

BACKGROUND

1. Technological Field

The present invention relates to an inkjet recording apparatus.

2. Description of the Related Art

There have been inkjet recording apparatuses each of which jets ink from nozzles of recording heads to the outer circumferential surface of a ring-shaped intermediate transfer body (e.g. an endless belt), thereby forming a primary image on the outer circumferential surface with the ink having landed thereon, and transfers the primary image to a recording medium, thereby recording an image on the recording medium. For such an inkjet recording apparatus, there is a technology of increasing transferability of the ink having landed on the outer circumferential surface of the intermediate transfer body to the recording medium by heating the intermediate transfer body and adjusting viscosity of the ink. As methods of heating the intermediate transfer body, there are known: a method of providing a heater in an internal space of the intermediate transfer body, the internal space being enclosed by the inner circumferential surface of the intermediate transfer body (for example, disclosed in JP 2011-152803 A.); and, with respect to an inkjet recording apparatus configured to cause a belt-shaped intermediate transfer body to circle by rotating a conveying roller abutting the inner circumferential surface of the intermediate transfer body, a method of heating the conveying roller with a heater.

SUMMARY

However, the method of providing the heater in the internal space of the intermediate transfer body tends to make a temperature of a part of the intermediate transfer body close to the upper end of the internal space high because the heated air stays around the upper end of the internal space in the vertical direction. Also, the method of heating the conveying roller with a heater tends to make a temperature of a part of the intermediate transfer body abutting the conveying roller high.

As described above, the conventional technologies cannot heat the intermediate transfer body uniformly, which results in a non-uniform temperature distribution of the intermediate transfer body. This may lead to non-uniform viscosity of the ink on the outer circumferential surface of the intermediate transfer body, and makes it difficult to transfer the ink to the recording medium stably.

Objects of the present disclosure include providing an inkjet recording apparatus that can transfer ink to a recording medium more stably.

In order to achieve at least one of the abovementioned objects, according to an aspect of the present invention, there is provided an inkjet recording apparatus including: an ink jetter that jets ink; and a transfer unit that includes a ring-shaped intermediate transfer body and transfers, to a recording medium, a primary image formed on an outer circumferential surface of the intermediate transfer body with the ink that is jetted to land on the outer circumferential surface by the ink jetter, the transfer unit further including a heater that heats air in an internal space of the intermediate transfer body enclosed by an inner circumferential surface of the intermediate transfer body, and an air mover that flows the air in the internal space.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein:

FIG. 8 is a table to explain a method of heating the intermediate transfer belt in warm-up operation and image recording operation;

FIG. 9 is a table to explain a method of adjusting a speed of air flow and a temperature of a heater according to an image coverage.

DETAILED DESCRIPTION OF EMBODIMENTS

Hereinafter, one or more embodiments according to an inkjet recording apparatus of the present invention will be described with reference to the drawings. However, the scope of the present invention is not limited to the disclosed embodiments.

Figure 1:
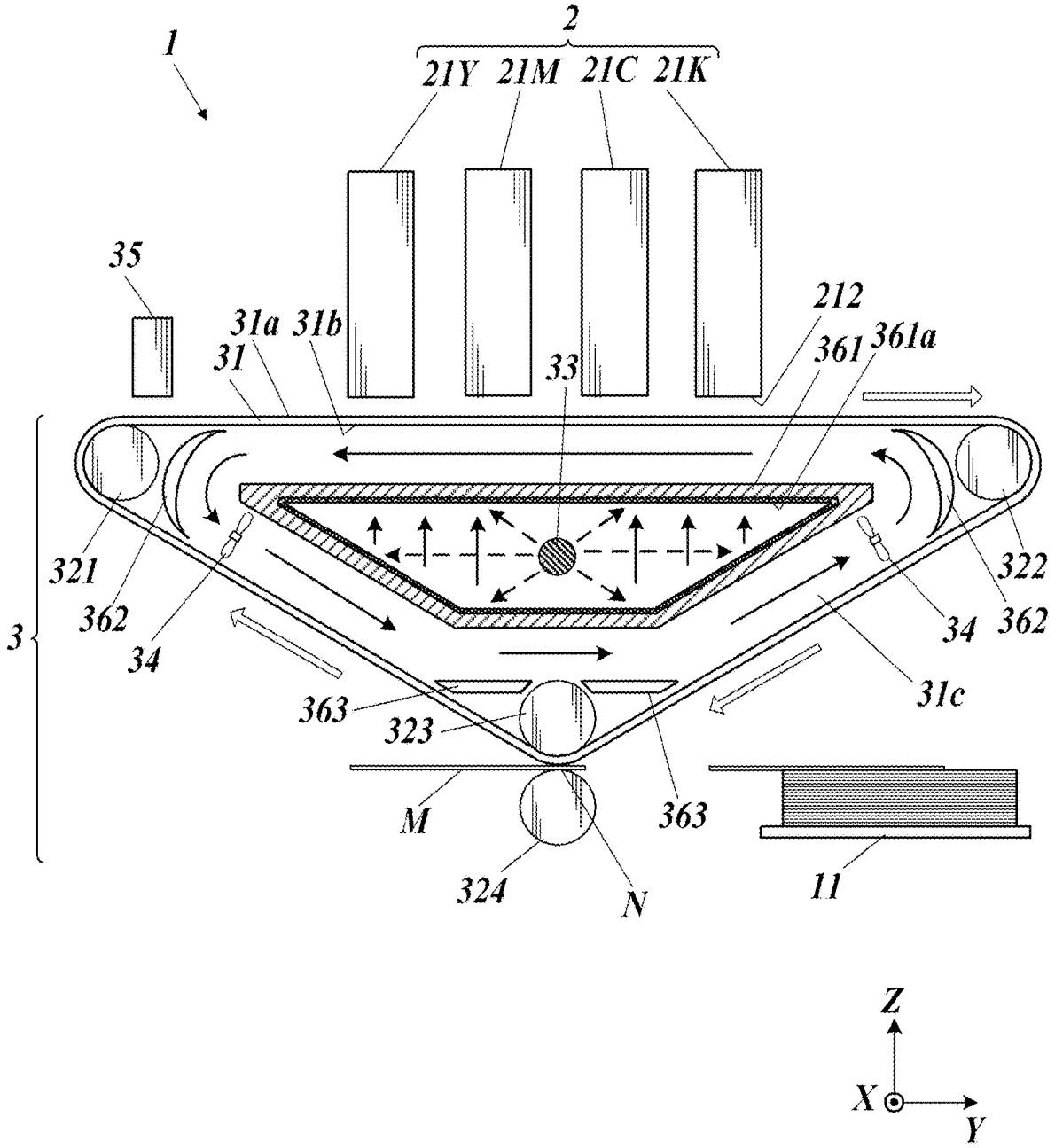
FIG. 1 shows a schematic configuration of an inkjet recording apparatus.

FIG. 1 shows a schematic configuration of an inkjet recording apparatus 1.

The inkjet recording apparatus 1 includes an ink jetter 2, a transfer unit 3, a controller 4 (hardware processor) (FIG. 7), and a medium feeder 11. The inkjet recording apparatus 1 jets ink from the ink jetter 2 to a belt-shaped intermediate transfer belt 31 of the transfer unit 3, thereby forming a primary image on an outer circumferential surface 31*a* (ink landing surface, image forming surface) of the intermediate transfer belt 31. The inkjet recording apparatus 1 then transfers the ink forming the primary image to a recording medium M fed by the medium feeder 11, thereby recording an image on the recording medium M. FIG. 1 shows a section of the inkjet recording apparatus 1 in the middle of the intermediate transfer belt 31 in the width direction.

The medium feeder 11 stores recording media M and feeds the recording media M to a transfer position of the transfer unit 3 in order. The medium feeder 11 includes a medium storage and a feeding roller (not illustrated). The medium storage stores a pile of recording media M, and the feeding roller sends out the uppermost recording medium M of the recording media M stored in the medium storage.

Examples of recording media M include various kinds of media, such as paper, resin plates, metal, fabric, and gum.

The paper can be plain paper, paperboard, coated paper, resin-coated paper, synthetic paper, and so forth.

The ink jetter 2 jets ink from nozzles to the outer circumferential surface 31*a* of the intermediate transfer belt 31 on the basis of image data, thereby forming a primary image on the outer circumferential surface 31*a*. The ink jetter 2 has a plurality of head units for a plurality of colors; here, four head units 21Y, 21M, 21C, 21K for colors of yellow (Y), magenta (M), cyan (C), and black (K), respectively (hereinafter, any of these head units may be called a head unit 21). The head units 21 each have an ink jetting surface 212. The ink jetting surfaces 212 are arranged so as to face the outer circumferential surface 31*a* of the intermediate transfer belt 31 at appropriate intervals. The number of the head units 21 may be more than or less than four.

Figure 2:
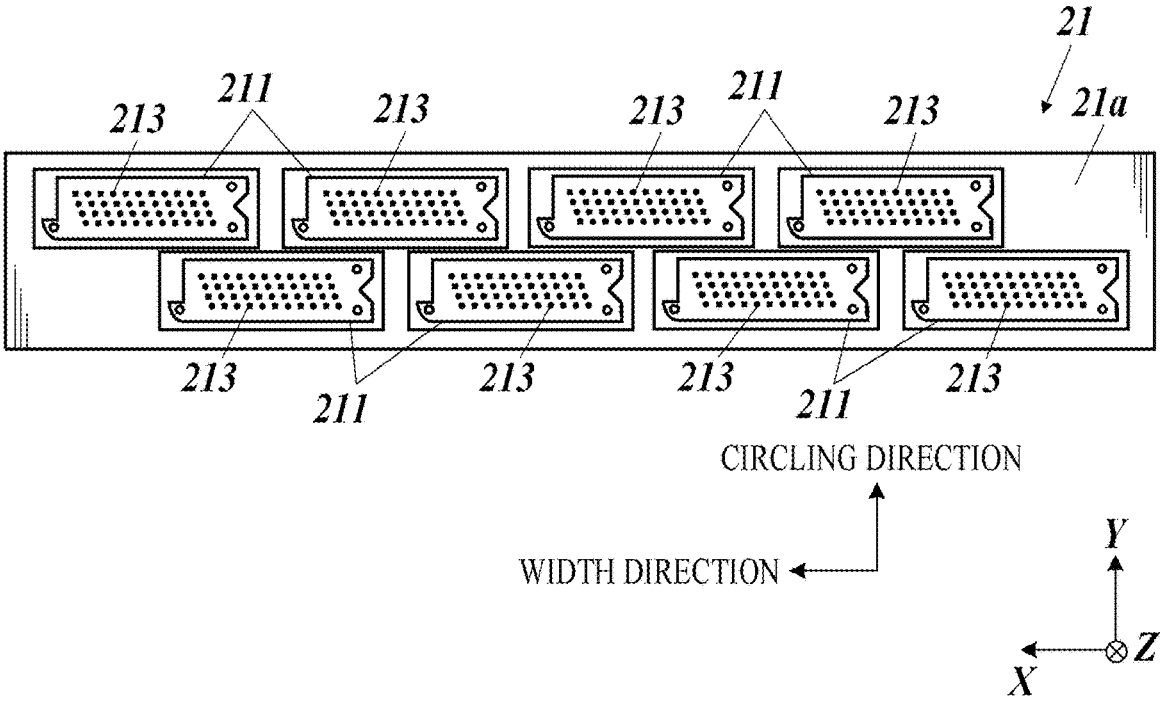
FIG. 2 is a schematic view of a configuration of a head unit.

FIG. 2 is a schematic view of the configuration of the head unit 21 showing a plan of the head unit 21 as seen from a side facing the outer circumferential surface 31*a* of the intermediate transfer belt 31. The head unit 21 has a plate-shaped support 21*a* and a plurality of (here, eight) recording heads 211 fixed to the support 21*a* by being fitted in through holes formed in the support 21*a*. The recording heads 211 are fixed to the support 21*a* such that nozzle surfaces (surfaces constituting the ink jetting surface 212 of the head unit 21) provided with opening parts of nozzles 213 are exposed to the outer circumferential surface 31*a* from the through holes of the support 21*a*.

In each recording head 211, the nozzles 213 are arranged at regular intervals in a direction crossing a direction in which the intermediate transfer belt 31 circles (hereinafter called the circling direction). In this embodiment, the nozzles 213 are arranged in the width direction (in X-axis direction in FIG. 1) perpendicular to the circling direction. In this embodiment, each recording head 211 has four nozzle lines in each of which the nozzles 213 are arranged one-dimensionally at regular intervals in the width direction. Positions of the four nozzle lines in the width direction are different from each other so that the positions of the nozzles 213 in the width direction do not coincide with each other. The number of the nozzle lines for each recording head 211 is not limited to four, but can be more than or less than four.

The eight recording heads 211 of the head unit 21 are arranged to be staggered so that the nozzles 213 are arranged continuously in the width direction. The arrangement area of the nozzles 213 of the head unit 21 in the width direction covers the width of a primary image forming area of the outer circumferential surface 31*a* of the intermediate transfer belt 31 in the width direction. When forming a primary image, the head unit 21 is used with its position fixed and, according to the circling movement of the intermediate transfer belt 31, jets ink from the nozzles 213 to positions on the intermediate transfer belt 31 at predetermined intervals in the circling direction, thereby forming the primary image with a single-pass system. The ink jetting mechanism of jetting ink from the nozzles 213 may be the one using a piezo method that utilizes piezoelectric elements or the one using a thermal method that makes ink gush out by heat.

The ink used in this embodiment changes its phases between gel and sol according to temperature (phase-change ink), and the viscosity of the ink increases as curing reaction progresses by ultraviolet irradiation (ultraviolet curable ink). When being heated to 70° C., the ink in this embodiment becomes sol having a viscosity suited for the ink jetting. The ink having become sol by heat is jetted from the nozzles 213 of the head unit 21, lands on the outer circumferential surface 31*a* of the intermediate transfer belt 31, and swiftly becomes gel by being cooled. The ink having become gel is transferred from the intermediate transfer belt 31 to the recording medium M, and then cures by ultraviolet irradiation, and fixes on the surface of the recording medium M.

The ink used in this embodiment contains photopolymerizable compounds (monomers), a photoinitiator, a gelling agent, and a coloring agent. The photopolymerizable compounds are compounds that become macromolecules by polymerization that progresses by ultraviolet irradiation. Being macromolecules increases the viscosity of the ink, thereby curing the ink. The photoinitiator is a compound for initiating the above polymerization. The gelling agent is a compound having properties of: dissolving in the ink when the ink is heated to a temperature equal to or higher than a solating temperature, thereby making the ink sol; and forming a bridged structure or fibrous associations when the ink is cooled to a temperature equal to or lower than a gelling temperature, thereby making the ink gel. The coloring agent contains a dye or a pigment of the color of the ink.

Figure 3:
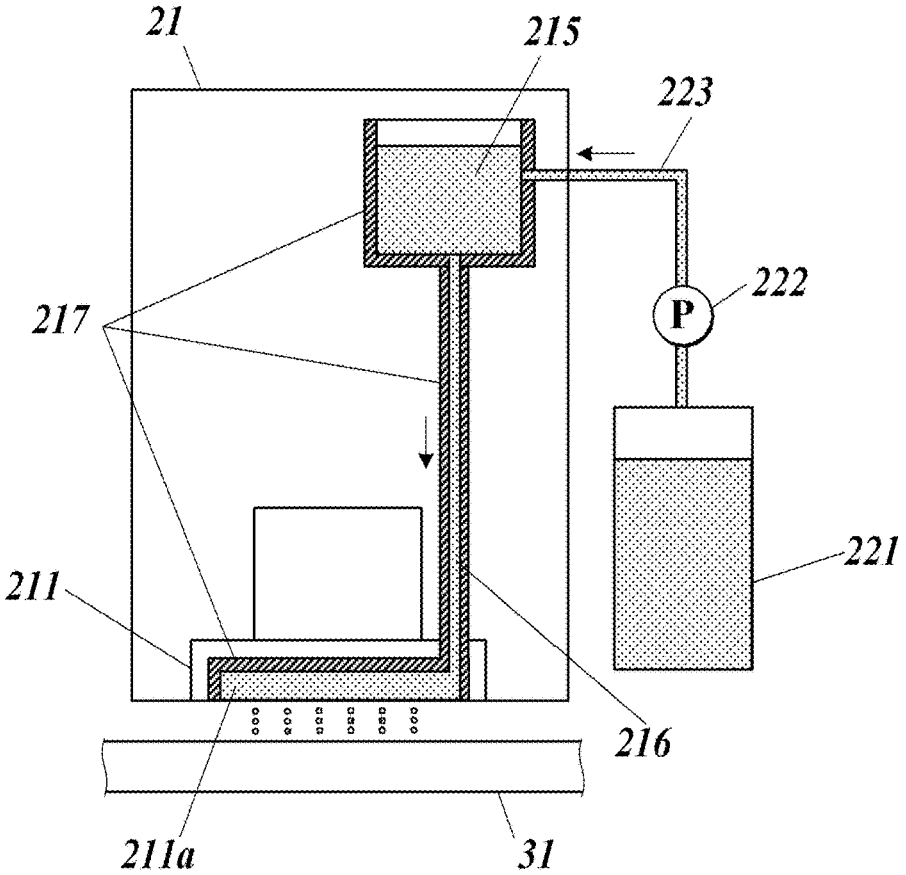
FIG. 3 is a schematic view of a configuration of an ink feeding mechanism that feeds ink to recording heads.

FIG. 3 is a schematic view of the configuration of an ink feeding mechanism that feeds ink to the recording heads 211.

In the ink feeding mechanism in FIG. 3, ink in a main tank 221 provided outside the head unit 21 is fed to a sub-tank 215 in the head unit 21 via an ink duct 223 by a feeding pump 222. In the head unit 21, the ink in the sub-tank 215 is fed to an in-recording-head duct 211*a* in each recording head 211 via an ink duct 216. The ink having flowed into the in-recording-head duct 211*a* is then led to pressure chambers (not illustrated) and jetted from the nozzles 213 as droplets by pressure fluctuation in the pressure chambers.

An ink backflow duct may be additionally provided to make the ink flow back to the sub-tank 215 from the recording heads 211.

Although FIG. 3 shows the ink feeding mechanism for one of the head units 21, the ink is fed by the same ink feeding mechanism for the other head units 21. The ink may be fed from a single sub-tank 215 to the recording heads 211, or may be fed from two or more sub-tanks 215 to their corresponding recording heads 211.

In this ink feeding mechanism, the sub-tank 215, the ink duct 216, and the in-recording-head duct 211*a* each have an ink heater 217 to heat the ink. The ink heaters 217 that heat the sub-tank 215, the ink duct 216, and the in-recording-head duct 211*a* are each provided with a thermocouple (not illustrated) to detect the temperature of the ink.

Each of the ink heaters 217 heats the ink to 70° C. under the control of the controller 4. Thus, the ink fed from the main tank 221 to the head units 21 at normal temperature is heated to a temperature suited for the ink jetting (in this embodiment, 70° C.), and is jetted from the nozzles 213.

Figure 4:
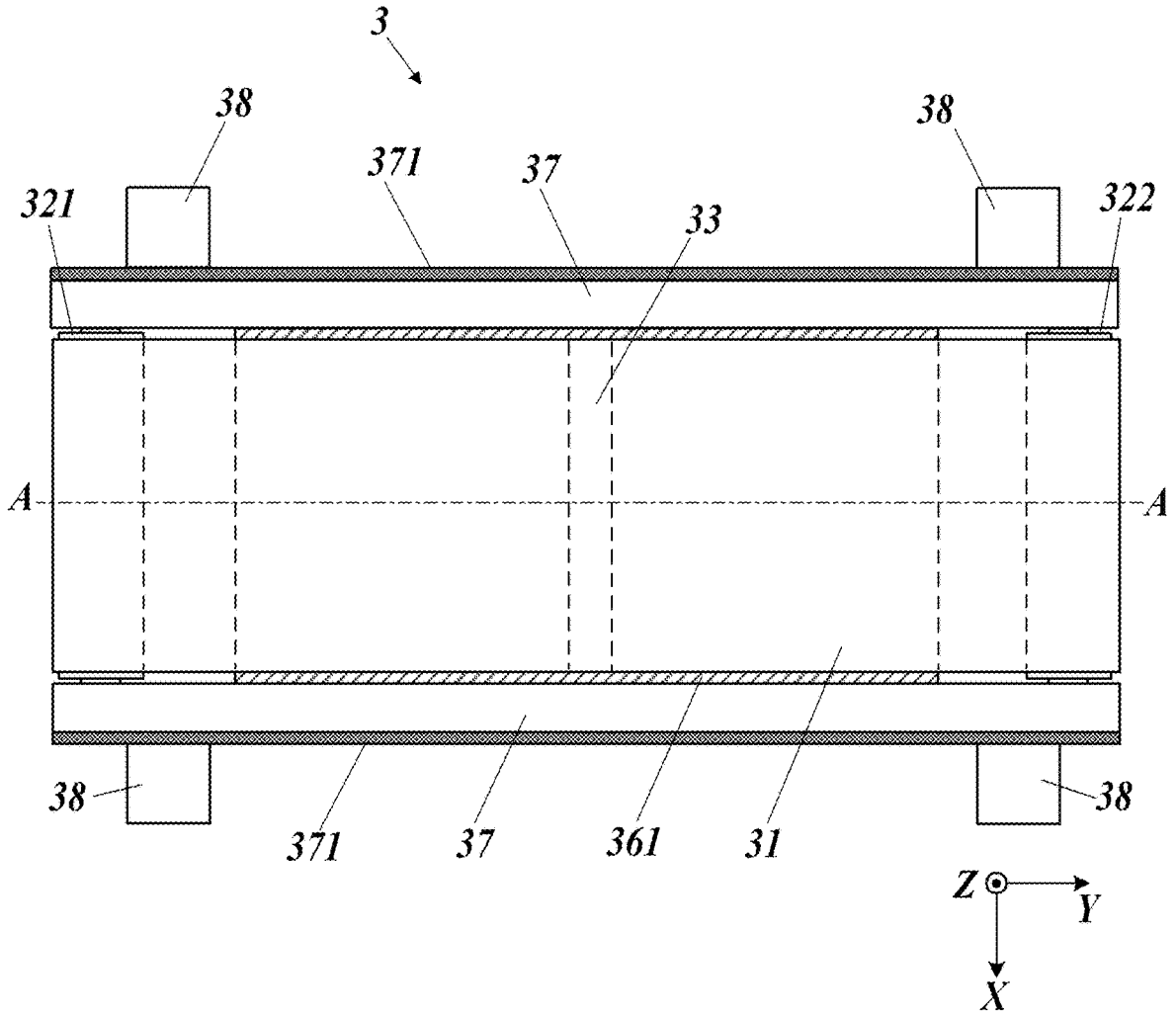
FIG. 4 is a depiction of a transfer unit as seen from Z-axis positive direction.

As shown in FIG. 1, the transfer unit 3 includes an intermediate transfer belt 31 (intermediate transfer body), a driving roller 321, a driven roller 322, a pressing roller 323, a transferring roller 324, a heater 33 (heater), fans 34 (air mover), a temperature detector 35, a beam member 361 (blocker), rectifying members 362, 363, outer panels 37 (separator(s)) (FIG. 4), and supporting members 38 (anchor(s)) (FIG. 4). The transfer unit 3 moves the intermediate transfer belt 31 and a recording medium M fed from the medium feeder 11, contacts them each other, and transfers a primary image formed on the intermediate transfer belt 31 to the recording medium M.

The intermediate transfer belt 31 is an endless (ring-shaped) member having the outer circumferential surface 31*a* on which ink jetted by the ink jetter 2 lands. On the outer circumferential surface 31*a* of the intermediate transfer belt 31, the primary image is formed with the ink having landed thereon, and a primary image is transferred to a recording medium M. The intermediate transfer belt 31 is stretched around the driving roller 321, the driven roller 322, and the pressing roller 323, and circles such that the outer circumferential surface 31*a* circles along a predetermined circling path in accordance with the rotation operation of the driving roller 321. In FIG. 1, the circling direction of the intermediate transfer belt 31 is represented by solid-white arrows. In this embodiment, the circling speed of the intermediate transfer belt 31 is 800 mm/sec in recording images on recording media M, and 200 mm/sec in warm-up operation described below. At least a part of the intermediate transfer belt 31 facing the ink jetter 2 is supported by a supporting plate having a flat surface (not illustrated), thereby being a horizontal plane.

The intermediate transfer belt 31 has a multilayered structure, and can be structured, for example, such that a member constituting the outer circumferential surface 31*a* is layered over a supporting layer having a predetermined level of rigidity and provided in the inner circumferential surface 31*b*. The material of the member constituting the outer circumferential surface 31*a* can be resin or metal impermeable to ink. More specifically, examples of the material of the member constituting the outer circumferential surface 31*a* include materials known to the public, such as a polyimide resin, a silicone resin, a polyurethane resin, a polyester resin, a polystyrene resin, a polyolefin resin, a polybutadiene resin, a polyimide resin, a polyvinyl chloride resin, a polyethylene resin, and a fluororesin.

The driving roller 321 rotates on its shaft parallel to X-axis direction in FIG. 1 in accordance with the drive of a motor (not illustrated). The driven roller 322 is provided a certain distance away from the driving roller 321, and rotates on its shaft parallel to the shaft of the driving roller 321 in accordance with the circling movement of the intermediate transfer belt 31.

Around the pressing roller 323, the intermediate transfer belt 31 is stretched. The pressing roller 323 may be movable so as to correct sags of the intermediate transfer belt 31.

The transferring roller 324 is arranged such that a nip part N is formed between the pressing roller 323 and the transferring roller 324. The intermediate transfer belt 31 and a recording medium M are pinched in the nip part N, and a primary image on the outer circumferential surface 31*a* of the intermediate transfer belt 31 is transferred to the recording medium M. Thus, an image is recorded on the recording medium M.

Figure 7:
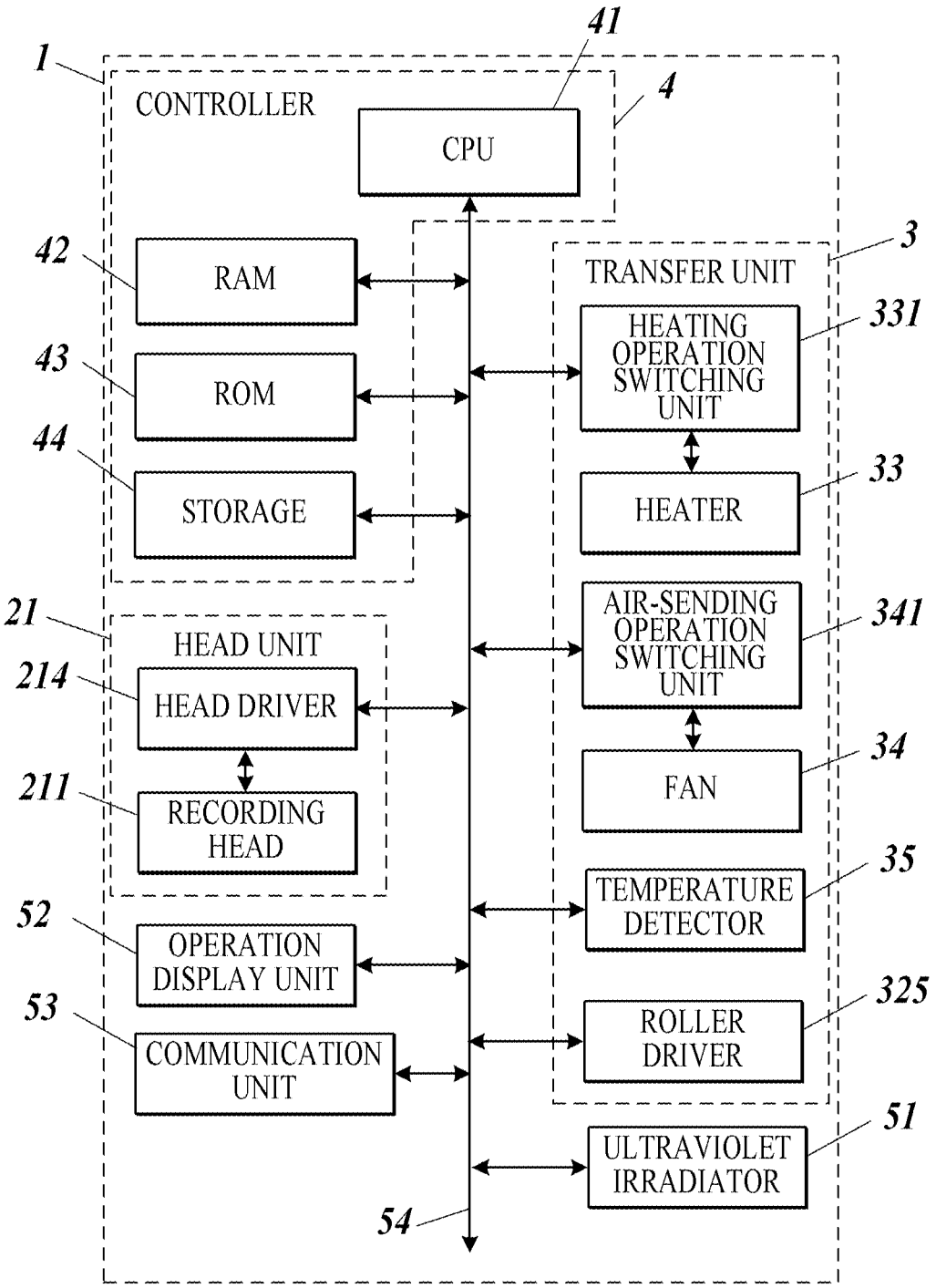
FIG. 7 is a block diagram of a functional configuration of the inkjet recording apparatus.

The recording medium M with the image recorded thereon is conveyed through an ultraviolet irradiation region that is irradiated by an ultraviolet irradiator 51 (FIG. 7). By being irradiated with ultraviolet rays in the ultraviolet irradiation region, the ink on the recording medium M cures and fixes thereon. The recording medium M with the ink fixed thereon is ejected to a predetermined medium receiver (not illustrated).

If a cure degree of ink by heat (a degree of gelation of the ink) on the outer circumferential surface 31*a* varies depending on positions on the outer circumferential surface 31*a* or changes temporally, the transfer unit 3 cannot transfer the ink to recording media M stably. This causes non-uniform glossiness or density in a recorded image, or variations in glossiness or density between recorded images on recording media M. It is hence desirable to keep a uniform temperature distribution of the intermediate transfer belt 31 so as to keep a uniform cure degree of ink by heat on the outer circumferential surface 31*a*.

More specifically, the inkjet recording apparatus 1 in this embodiment keeps the temperature distribution of the intermediate transfer belt 31 within the range of 40±3° C., thereby being able to record images with desired image quality. Because the normal temperature of the outside of the intermediate transfer belt 31 (temperature in the inkjet recording apparatus 1) is approximately 30° C., the intermediate transfer belt 31 needs to be uniformly heated to have a temperature within the above range.

The transfer unit 3 in this embodiment has a heating mechanism consisting mainly of the heater 33, the fans 34, the temperature detector 35, the beam member 361, and the rectifying members 362, 363 to heat the intermediate transfer belt 31 to a temperature within the above range. This heating mechanism is hereinafter described with reference to FIG. 1 and FIGS. 4 to 6.

FIG. 4 is a depiction of the transfer unit 3 as seen from Z-axis positive direction.

Figure 5:
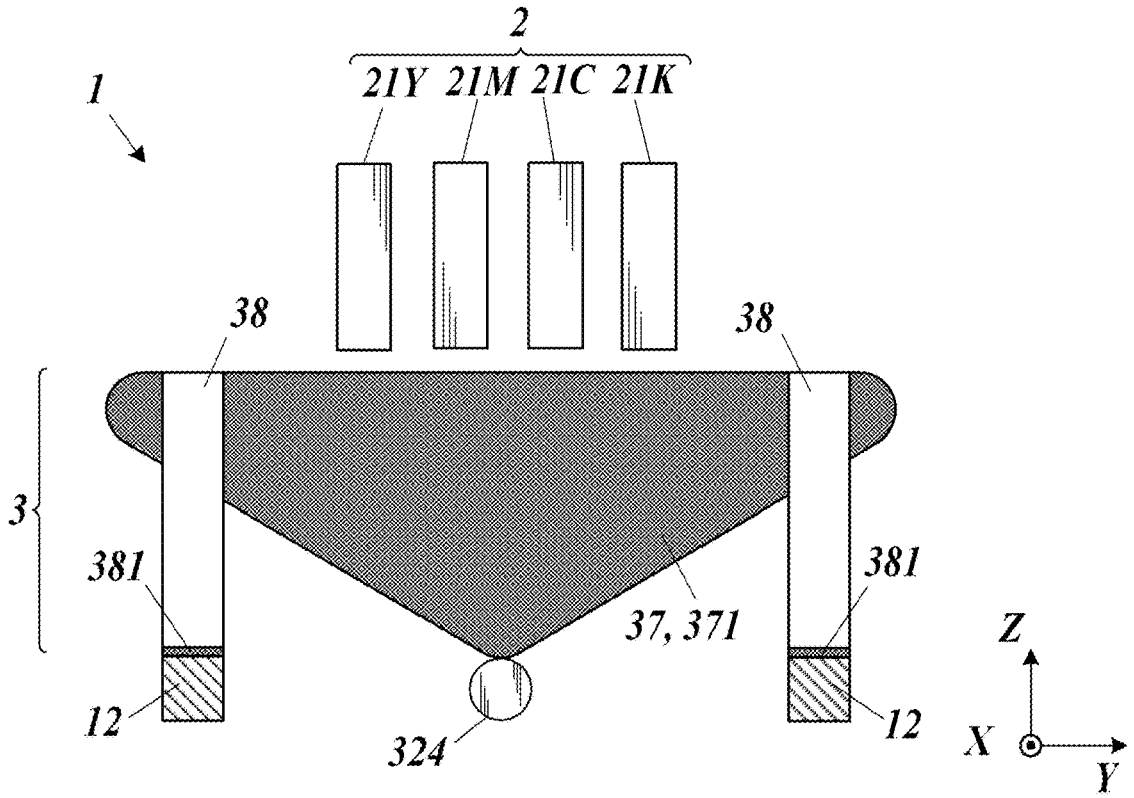
FIG. 5 is an exterior view of the inkjet recording apparatus as seen from X-axis positive direction.

FIG. 5 is an exterior view of the inkjet recording apparatus 1 as seen from X-axis positive direction.

Figure 6:
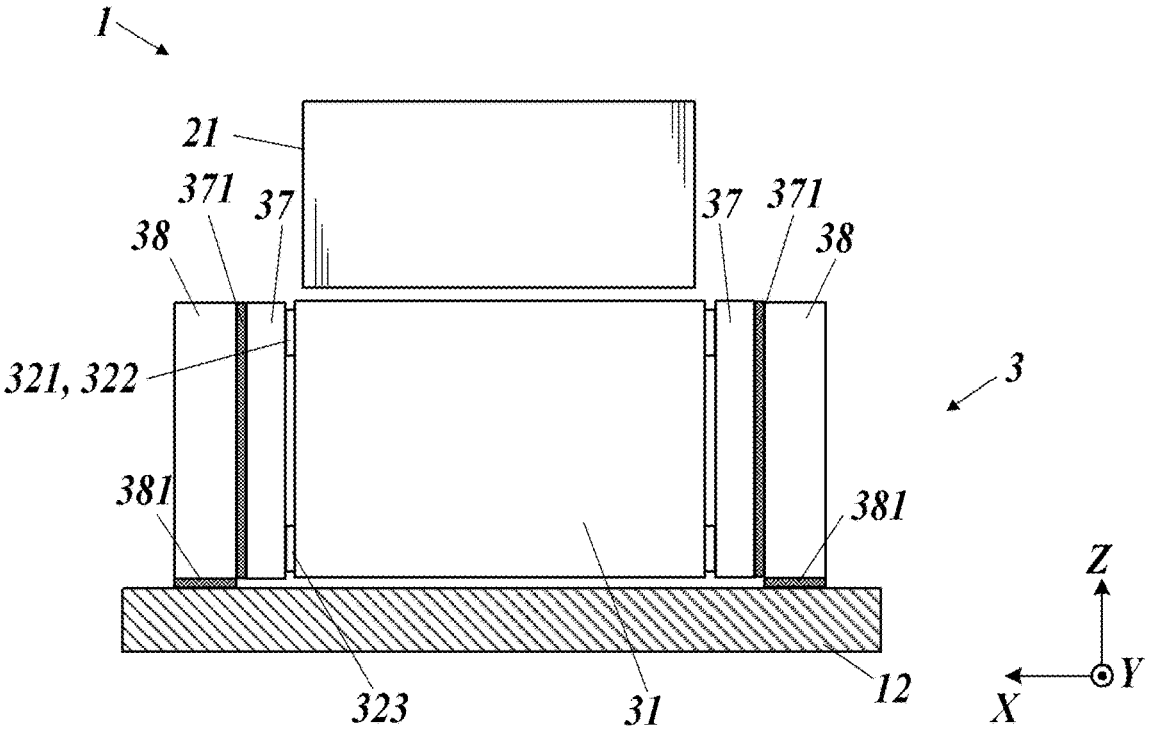
FIG. 6 is an exterior view of the inkjet recording apparatus as seen from Y-axis positive direction.

FIG. 6 is an exterior view of the inkjet recording apparatus 1 as seen from Y-axis positive direction.

As shown in FIGS. 4 to 6, the transfer unit 3 is configured such that the lateral sides of the intermediate transfer belt 31 are covered by the outer panels 37. Furthermore, as shown in FIG. 4, positional relationships between the intermediate transfer belt 31 and the outer panels 37 are determined such that a gap between the intermediate transfer belt 31 and each of the outer panels 37 is extremely small. In such a configuration, an internal space 31*c* enclosed by the inner circumferential surface 31*b* of the intermediate transfer belt 31 is almost isolated from the outside.

The internal space 31*c* is, more specifically, a space enclosed by: the inner circumferential surface 31*b* of the intermediate transfer belt 31; and planes contacting their respective lateral ends of the intermediate transfer belt 31. In this embodiment, the internal space 31*c* is separated from the external space by the intermediate transfer belt 31 and a pair of outer panels 37 provided along the planes contacting their respective lateral ends of the intermediate transfer belt 31.

Each of the outer panels 37 is provided, as shown in FIG. 5, in an inverted-round-triangle-shaped region as seen from X-axis positive direction formed by the intermediate transfer belt 31. That is, the pair of outer panels 37 provided along the planes contacting their respective lateral ends of the intermediate transfer belt 31 separates the internal space 31*c* from the outside. The material of the outer panels 37 is not limited to a particular material, but may be metal, such as stainless steel.

The transfer unit 3 heats the intermediate transfer belt 31 by heating the internal space 31*c* isolated from the outside with the heater 33.

The heater 33 is a halogen heater provided with halogen lamps in a cylindrical glass tube extending in X-axis direction. The heater 33 is provided approximately at the center of the internal space 31*c* of the intermediate transfer belt 31 as shown in FIG. 1, and extends so as to cover the whole width of the intermediate transfer belt 31 in X-axis direction. The heater 33 generates heat by introducing electric currents to the halogen lamps, and transmits the heat to the air in the internal space 31*c*. Instead of the halogen heater, a carbon heater, a silicone rubber heater, and so forth may be used. The heater 33 is not limited to a tubular one, and may be a sheet-shaped heater, such as a silicone rubber with heating elements spread thereon. A temperature detector, such as a thermocouple, may be additionally provided to detect a temperature of the heater 33.

The temperature of the heater 33 can be adjusted under the control of the controller 4.

As shown in FIG. 1, the beam member 361 is provided in the internal space 31*c* so as to encircle the heater 33 as seen from X-axis direction. More specifically, the beam member 361 is a plate-shaped member arranged between the outer panels 37 and made of four plate-shaped members joined closely so as to form a trapezoid having the lower base shorter than the upper base as seen from X-axis direction. The beam member 361 may be made of one continuous member.

Among the four plate-shaped members constituting the beam member 361, the member constituting the upper base of the trapezoid is arranged parallel to a part of the intermediate transfer belt 31 between the driving roller 321 and the driven roller 322. The plate-shaped members constituting the legs (oblique sides) of the trapezoid are arranged parallel to a part of the intermediate transfer belt 31 between the driven roller 322 and the pressing roller 323 and a part of the intermediate transfer belt 31 between the pressing roller 323 and the driving roller 321, respectively. The member constituting the lower (shorter) base of the trapezoid is arranged parallel to the rectifying members 363 described below. The beam member 361 formed as described above, the inner circumferential surface 31*b* of the intermediate transfer belt 31, and the pair of outer panels 37 constitute a ring-shaped air flow duct (hereinafter called air circulating duct) along the inner circumferential surface 31*b*.

Although the material of the beam member 361 is not limited to a particular one, it is desirable to use a material that conducts heat well, such as various metals including aluminum and a carbon material.

The inner circumferential surface of the beam member 361 is provided with a reflecting member 361*a* that easily reflects electromagnetic waves (heat radiation) emitted by the heater 33, such as aluminum foil. If the material of the beam member 361 easily reflects electromagnetic waves from the heater 33, the reflecting member 361*a* may be omitted.

The beam member 361 supports the pair of outer panels 37 in X-axis direction, and blocks the heat radiation (electromagnetic waves) from the heater 33 to the intermediate transfer belt 31. In FIG. 1, dashed lines extending from the heater 33 represent directions in which the heat radiation from the heater 33 is propagated. The beam member 361 blocking the heat radiation can restrain the heater 33 from heating a part of the intermediate transfer belt 31 close to the heater 33 by the heat radiation. Furthermore, with the reflecting member 361*a* provided on the inner circumferential surface of the beam member 361, the heat radiation can be more efficiently blocked.

Thus, the intermediate transfer belt 31 is not heated by the heat irradiation much, but heated mainly by the convection transmitting the heat of the heater 33. That is, the intermediate transfer belt 31 is heated by the heat transmitted from the heater 33 to the inner circumferential surface 31*b* in the order of the heater 33, the air around the heater 33 (the air in the beam member 361), the beam member 361, the air outside the beam member 361, and the inner circumferential surface 31*b*.

The fans 34 are provided at two air sending positions in the air circulating duct. More specifically, a plurality of fans 34 is arranged in the width direction in each of the air sending positions, one position being near the driving roller 321 and the other being near the driven roller 322.

By rotating and sending air, the fans 34 move the air in the air circulating duct, and flow and circulate the air along the air circulating duct. In FIG. 1, solid lines represent directions in which the air flows/circulates in the air circulating duct. Here, the direction in which the fans 34 flow the air is counter to the circling direction of the intermediate transfer belt 31. This increases a relative speed between the air in the air circulating duct and the intermediate transfer belt 31, thereby increasing a heat transfer coefficient between the air and the intermediate transfer belt 31 (i.e. heat is easily transmitted from the air to the intermediate transfer belt 31).

Furthermore, the fans 34 are provided in regions that do not overlap the ink jetting surfaces 212 as seen in a direction perpendicular to a portion of the outer circumferential surface 31*a* facing the ink jetting surfaces 212. If the fans 34 are provided in regions that overlap the ink jetting surfaces 212 as seen in the above direction, vibrations due to the operation of the fans 34 are transmitted to the intermediate transfer belt 31 and changes a distance between the ink jetting surfaces 212 of the ink jetter 2 and the intermediate transfer belt 31, which leads to decrease in quality of recorded images.

The rectifying members 362 are provided near the driving roller 321 and the driven roller 322, respectively, in the air circulating duct. The rectifying members 363 are provided near the pressing roller 323 in the air circulating duct. The rectifying members 362, 363 are provided so as to prevent the air from entering regions around the driving roller 321, the driven roller 322, and the pressing roller 323 and causing turbulent flows.

The rectifying members 362 are plate-shaped members curved along the curves at the corners of the air circulating duct. The rectifying members 363 are flat-plate-shaped members parallel to the horizontal plane of the lower side of the beam member 361. However, the shapes of the rectifying members 362, 363 are not limited to these. The rectifying members 362 may be flat-plate-shaped, and the rectifying members 363 may be curved along the air circulating duct, for example.

The temperature detector 35 is provided upstream from the ink jetter 2 in the circling direction of the intermediate transfer belt 31. The temperature detector 35 detects the temperature of the intermediate transfer belt 31, and outputs data of the detection result to the controller 4. Although the configuration of the temperature detector 35 is not specifically limited, the temperature detector 35 can be, for example, a radiation thermometer that detects radiant quantities of infrared rays from the surface of the intermediate transfer belt 31 and determines the temperature. Various other kinds of thermometers, such as the one that detects a temperature on the basis of outputs of a thermocouple, may be used as the temperature detector 35.

The position of the temperature detector 35 is not limited to the upstream side from the ink jetter 2 in the circling direction, but may be the upstream side from the nip part N formed between the pressing roller 323 and the transferring roller 324. The temperature detectors 35 may be provided at two or more positions to obtain and use the average value of the detection results by the temperature detectors 35.

As shown in FIGS. 4 to 6, the supporting members 38 are fitted to each of the external surfaces of the outer panels 37 (surfaces opposite the internal space 31*c*) to support the whole body of the transfer unit 3. The supporting members 38 are members that anchor the transfer unit 3 to a frame member 12 (basement) constituting the framework of the inkjet recording apparatus 1. The supporting members 38 in this embodiment are pillar-shaped members fixed on the frame member 12, and fixed at two positions of the both outer panels 37. That is, four supporting members 38 are provided in total. Although the material of the supporting members 38 is not particularly limited, stainless steel may be used, for example. The supporting members 38 are not limited to those anchoring the transfer unit 3 on the frame member 12 provided under the transfer unit 3. The supporting members 38 may anchor the transfer unit 3 on a frame member provided above the transfer unit 3 such that the transfer unit 3 is hung from the frame member.

The surface of each outer panel 37 contacting the external space is provided with a heat insulator 371 (first heat insulator).

Furthermore, the surface of each supporting member 38 contacting the frame member 12 is provided with a heat insulator 381 (second heat insulator). As the heat insulators 371, 381, films made of material having small heat conductivity, such as resin (e.g. urethane and polystyrene) and rubber, can be used.

The heat insulators 371, 381, which are provided on the parts of the transfer unit 3 contacting the outside of the transfer unit 3, allows the transfer unit 3 to have a heat-insulated structure. This makes it possible to efficiently and stably adjust the temperature in the internal space 31*c* of the intermediate transfer belt 31 and the temperature of the intermediate transfer belt 31 to their respective desired temperatures.

FIG. 7 is a block diagram showing the functional configuration of the inkjet recording apparatus 1.

The inkjet recording apparatus 1 includes: the controller 4; the transfer unit 3 including the heater 33, a heating operation switching unit 331, an air-sending operation switching unit 341, the fans 34, the temperature detector 35, and a roller driver 325 (intermediate transfer body driver); the head units 21 including head drivers 214 and the recording heads 211; the ultraviolet irradiator 51; an operation display unit 52; a communication unit 53; and a bus 54.

The controller 4 is a processor that integrally controls operation of the inkjet recording apparatus 1. The controller 4 includes a central processing unit (CPU) 41, a random access memory (RAM) 42, a read only memory (ROM) 43, and a storage 44.

The CPU 41 reads out programs for various kinds of control and setting data that are stored in the ROM 43, causes the RAM 42 to store the read ones, and performs various kinds of arithmetic processing by executing the programs. The CPU 41 integrally controls the overall operation of the inkjet recording apparatus 1.

More specifically, the CPU 41 controls the temperature of the heater 33 (e.g. Proportional-Integral-Differential (PID) control) by outputting control signals to the heating operation switching unit 331 on the basis of the temperature of the intermediate transfer belt 31 detected by the temperature detector 35. The CPU 41 controls the rotation speed of the fans 34 by outputting control signals to the air-sending operation switching unit 341 on the basis of the temperature of the intermediate transfer belt 31 detected by the temperature detector 35.

The RAM 42 provides the CPU 41 with a memory space for work, and stores temporary data. The RAM 42 may include a nonvolatile memory.

The ROM 43 stores the programs for various kinds of control, which are executed by the CPU 41, the setting data, and so forth. Instead of the ROM 43, a rewritable nonvolatile memory, such as a flash memory, may be used.

The storage 44 stores, for example, job data input from an external apparatus via the communication unit 53 and including image data to be recorded and operation settings related to recording operation of the image data. As the storage 44, for example, a hard disk drive (HDD) is used, or a dynamic random access memory (DRAM) may be jointly used.

The heating operation switching unit 331 switches the supply of electricity for the heater 33. That is, the heating operation switching unit 331 switches the operation (generation of heat) of the heater 33 in accordance with control signals input by the controller 4. The switching may be simple on-off switching (two levels) or stepwise switching (more than two levels). Pulse width modulation (PWM) control may be also performed by the on-off switching at a high switching frequency.

The air-sending operation switching unit 341 switches the rotation speed of the fans 34 (the number of rotations per unit time) in accordance with control signals input by the controller 4.

The roller driver 325 outputs, in accordance with control signals input by the controller 4, driving signals that causes the motor, which rotates the driving roller 321, to perform a rotation operation at a predetermined rotation speed, thereby causing the intermediate transfer belt 31 to circle at a predetermined speed.

The head drivers 214 output, in accordance with control signals input by the controller 4, image data and/or control signals to the recording heads 211 at appropriate timings according to the circling movement of the intermediate transfer belt 31, thereby causing the recording heads 211 to jet ink from the nozzles 213.

The ultraviolet irradiator 51 is provided near the conveying path of the recording medium M to which the ink has been transferred by the transferring roller 324. Under the control of the controller 4, the ultraviolet irradiator 51 irradiates the surface(s) of the recording medium M on the conveying path with ultraviolet rays having a predetermined level of intensity. The ultraviolet irradiation by the ultraviolet irradiator 51 completely cures the ink transferred to the recording medium M, thereby making the ink adhere to and fix to the surface of the recording medium M by an anchor effect.

The operation display unit 52 includes: a display, such as a liquid crystal display and an organic electroluminescent display; and an input unit with operation keys and/or a touchscreen arranged over the screen of the display. The operation display unit 52 displays various kinds of information on the display, and also converts input operation performed to the input unit by a user to operation signals, and outputs the operation signals to the controller 4.

The communication unit 53 communicates with an external apparatus(es) and exchanges information. The communication unit 53 controls communication in accordance with various communication standards regarding wired or wireless communication on a LAN. Data received by the communication unit 53 include the job data described above. Data sent by the communication unit 53 includes status information related to the progress of the image recording operation in accordance with the job data.

The bus 54 is a signal channel for the controller 4 and the other components to exchange signals.

Next, operation of heating the intermediate transfer belt 31 is described.

The inkjet recording apparatus 1 performs warm-up operation of heating ink in the ink jetter 2 (the head units 21) and the intermediate transfer belt 31 of the transfer unit 3 to their respective predetermined temperatures before starting image recording operation in which images are recorded to recording media M. After finishing the warm-up operation of heating the ink jetter 2 and the intermediate transfer belt 31 and starting the image recording operation, the inkjet recording apparatus 1 controls operation of the heater 33 and the fans 34 so that the temperature distribution of the intermediate transfer belt 31 is kept within a predetermined temperature range.

Hereinafter, a method of heating the intermediate transfer belt 31 in the warm-up operation and the image recording operation is described.

FIG. 8 is a table to explain the method of heating the intermediate transfer belt 31 in the warm-up operation and the image recording operation.

FIG. 8 shows requirements in each of the warm-up operation and the image recording operation regarding the circling speed of the intermediate transfer belt 31 and the speed of the air flow (forced convection speed) in the air circulating duct (internal space 31*c*), and the relative speed between the intermediate transfer belt 31 and the air flow to be obtained by meeting the requirements.

As shown in FIG. 8, in the warm-up operation, the intermediate transfer belt 31 is made to circle at a low speed of 200 mm/sec. Besides that, the fans 34 are operated so as to obtain the forced convection speed of 400 mm/sec while the heater 33 heats up until the temperature of the intermediate transfer belt 31 reaches a target temperature (40±3° C.).

Because the intermediate transfer belt 31 is made to circle in the warm-up operation, the intermediate transfer belt 31 is restrained from having a non-uniform temperature due to heat from the other components of the inkjet recording apparatus 1. Furthermore, because the intermediate transfer belt 31 in the warm-up operation is made to circle at a speed lower than the speed in the image recording operation (800 mm/sec), the intermediate transfer belt 31, the driving roller 321, the driven roller 322, the pressing roller 323, and the transferring roller 324, which contact the intermediate transfer belt 31, are restrained from being worn away.

Here, in both the warm-up operation and the image recording operation, the relative speed between the intermediate transfer belt 31 and the air flow needs to be equal to or higher than a predetermined reference relative speed so as to secure a required heat transfer coefficient between the intermediate transfer belt 31 and the air in the internal space 31*c*. The reference relative speed is determined on the basis of the configuration of an inkjet recording apparatus, materials constituting components of the inkjet recording apparatus, and a desired heat efficiency. The reference relative speed for the inkjet recording apparatus 1 in this embodiment is 500 mm/sec.

Because the intermediate transfer belt 31 in the warm-up operation circles at a low speed of 200 mm/sec, the speed of the air flow in the air circulating duct (forced convection speed) is increased to 400 mm/sec so as to secure the relative speed equal to or higher than the reference relative speed. Here, the relative speed of 600 mm/sec is secured.

Under the condition described above, the time required to finish the warm-up operation of the transfer unit 3 (i.e. to heat the intermediate transfer belt 31 at the normal temperature up to the target temperature (40° C.)) is approximately 20 minutes.

On the other hand, the time required to finish the warm-up operation of the ink jetter 2 (i.e. to heat the ink at the normal temperature in the sub-tank 215, the ink duct 216, and the in-recording-head duct 211*a* of the head unit 21 up to a predetermined jetting temperature (70° C.)) is approximately 30 minutes.

Thus, the warm-up operation of the transfer unit 3 is controlled to finish earlier than the warm-up operation of the ink jetter 2, which starts at the same time as the warm-up operation of the transfer unit 3. The above is the case of a cold start, and if a temperature history (records) of the last warm-up operation or the last image recording operation remains, the time for the warm-up is further shortened. In any case, the transfer unit 3 tends to have a standby time after the warm-up operation of the intermediate transfer belt 31 finishes. This allows the inkjet recording apparatus 1 to avoid taking long time for the warm-up operation of the overall inkjet recording apparatus 1 (standby time until the image recording operation starts) owing to the warm-up operation of the transfer unit 3.

After finishing the warm-up operation of the ink jetter 2 and the transfer unit 3, the inkjet recording apparatus 1 starts the image recording operation of recording an image to a recording medium M.

As shown in FIG. 8, the intermediate transfer belt 31 in the image recording operation is made to circle at a high speed of 800 mm/sec. This allows the speed of the air flow in the air circulating duct to be 200 mm/sec, which is lower than the speed of the air flow in the warm-up operation. This lower speed of the air flow still yields the relative speed of 1000 mm/sec between the intermediate transfer belt 31 and the air flow in the air circulating duct, thereby securing the relative speed equal to or higher than the reference relative speed. Furthermore, the lower speed of the air flow (i.e. lower rotation speed of the fans 34) in the image recording operation generates less vibrations of the inkjet recording apparatus 1, which restrains decrease in quality of recorded images.

In the image recording operation, because ink having a high temperature (70° C.) lands on the outer circumferential surface 31*a* of the intermediate transfer belt 31, the heat transmitted from the ink can fluctuate the temperature of the intermediate transfer belt 31. The amount of the heat transmitted from the ink to the intermediate transfer belt 31 depends on a ratio (hereinafter called the image coverage) of parts of image forming areas on which primary images are formed on the outer circumferential surface 31*a* of the intermediate transfer belt 31 to the whole image forming areas, the parts being covered by the ink on the basis of the content of images to be recorded.

The inkjet recording apparatus 1 in this embodiment restrains the fluctuations of the temperature of the intermediate transfer belt 31 in the image recording operation by adjusting the speed of the air flow in the air circulating duct and the temperature of the heater 33 on the basis of the image coverage.

FIG. 9 is a table to explain a method of adjusting the speed of the air flow and the temperature of the heater 33 on the basis of the image coverage.

As shown in FIG. 9, if "10%<image coverage≤50%" holds, the speed of the air flow is not adjusted, and the air is flowed at its normal speed shown in FIG. 8. The temperature of the heater 33 is set at 50° C. as its normal degree.

If "50%<image coverage" holds, because a larger amount of heat is transmitted from the ink to the intermediate transfer belt 31, the speed of the air flow and the temperature of the heater 33 are adjusted so that a smaller amount of heat is transmitted from the internal space 31*c* to the intermediate transfer belt 31. More specifically, the rotation speed of the fans 34 is adjusted so that the speed of the air flow in the air circulating duct decreases by 20%, and the temperature of the heater 33 is set at 49° C., which is lower than the normal degree by 1° C.

If "image coverage≤10%" holds, because a smaller amount of heat is transmitted from the ink to the intermediate transfer belt 31, the speed of the air flow and the temperature of the heater 33 are adjusted so that a larger amount of heat is transmitted from the internal space 31*c* to the intermediate transfer belt 31. More specifically, the rotation speed of the fans 34 is adjusted so that the speed of the air flow in the air circulating duct increases by 20%, and the temperature of the heater 33 is set at 51° C., which is higher than the normal degree by 1° C.

The image coverage used in the adjustment operation is calculated on the basis of, for example, image data of images to be recorded.

The adjustment method based on the image coverage is not limited to the above. Either the speed of the air flow in the air circulating duct or the temperature of the heater 33 only may be adjusted.

Next, a control procedure of an image recording process by the controller 4 for performing the warm-up operation and the image recording operation is described.

Figure 10:
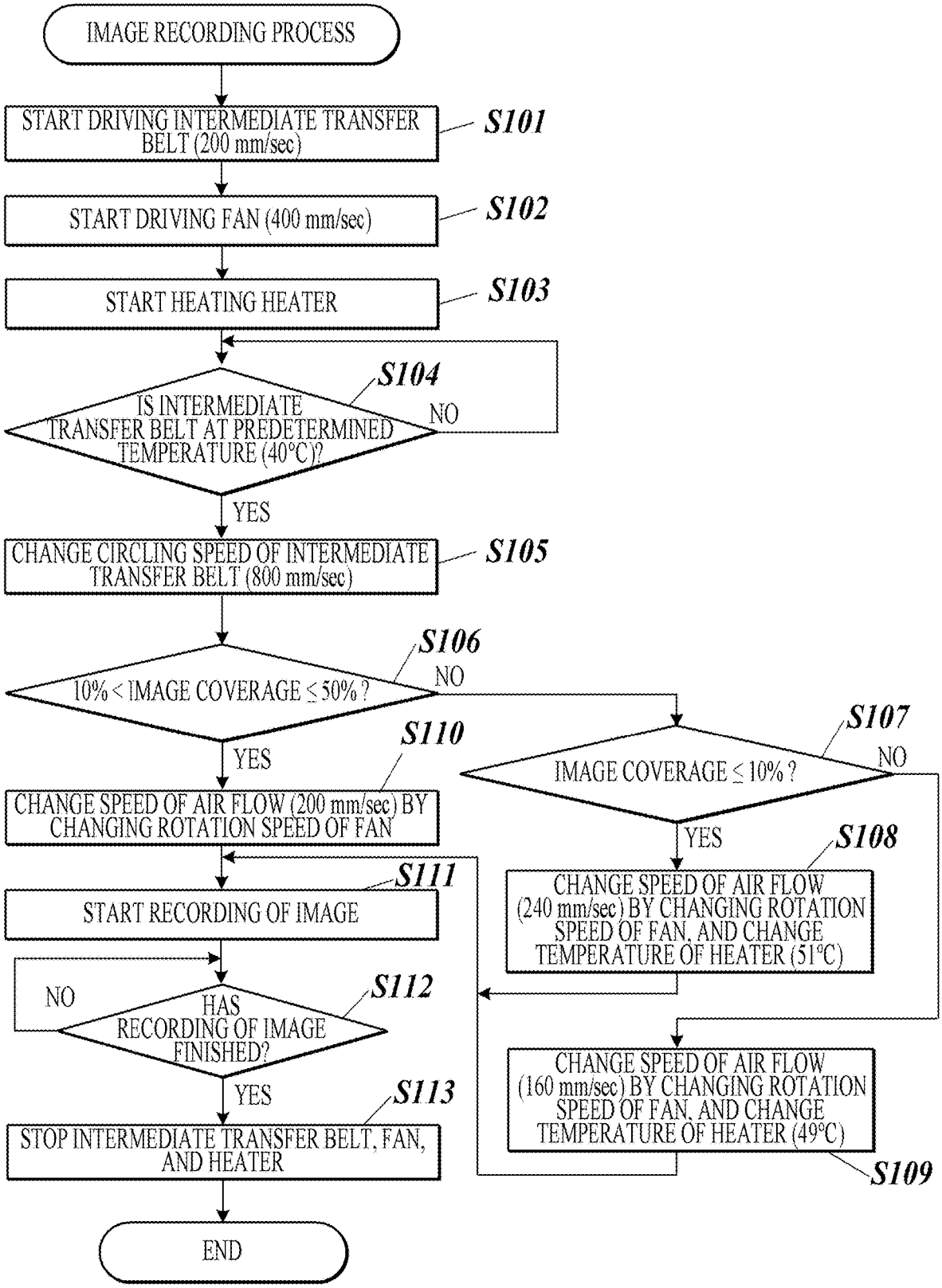
FIG. 10 is a flowchart of a control procedure of an image recording process.

FIG. 10 is a flowchart showing the control procedure of the image recording process.

The image recording process starts when job data including image data is stored in the storage 44.

When the image recording process starts, the controller 4 outputs control signals to the roller driver 325 to start driving the intermediate transfer belt 31 with the driving roller 321 and make the intermediate transfer belt 31 circle at a speed of 200 mm/sec (Step S101).

The controller 4 outputs control signals to the air-sending operation switching unit 341 to start driving the fans 34 and make the fans 34 rotate at a predetermined rotation speed that yields the speed of the air flow in the air circulating duct of 400 mm/sec (Step S102).

The controller 4 outputs control signals to the heating operation switching unit 331 to start heating operation of the heater 33 (Step S103). More specifically, the controller 4 causes the heating operation switching unit 331 to increase the temperature of the heater 33 to a high temperature of 140° C. so as to rapidly increase the temperature of the air in the internal space 31*c*, and then gradually decrease the temperature of the heater 33 to 50° C. in a predetermined sequence (Step S103).

The controller 4 obtains a temperature detection result by the temperature detector 35, and determines whether or not the surface temperature of the intermediate transfer belt 31 has reached a predetermined temperature (40° C.) (Step S104). If the controller 4 determines that the surface temperature of the intermediate transfer belt 31 has not reached the predetermined temperature (Step S104: NO), the controller 4 performs the action in Step S104 again.

If the controller 4 determines that the surface temperature of the intermediate transfer belt 31 has reached the predetermined temperature (Step S104: YES), the controller 4 outputs control signals to the roller driver 325 to change the circling speed of the intermediate transfer belt 31, which is driven by the driving roller 321, to 800 mm/sec (Step S105).

The controller 4 calculates the image coverage on the basis of the image data included in the job data, and determines whether or not "10%<image coverage≤50%" holds (Step S106). If the controller 4 determines that "10%<image coverage≤50%" does not hold (Step S106: NO), the controller 4 determines whether or not "image coverage≤10%" holds (Step S107).

If the controller 4 determines that "image coverage≤10%" holds (Step 107: YES), the controller 4 outputs control signals to the air-sending operation switching unit 341 to change the rotation speed of the fans 34 so that the speed of the air flow in the air circulating duct becomes 240 mm/sec, which is higher than the normal speed by 20% (Step S108). The controller 4 also outputs control signals to the heating operation switching unit 331 to change the temperature of the heater 33 to 51° C., which is higher than the normal degree by 1° C. (Step S108).

If the controller 4 determines that "image coverage≤10%" does not hold, namely that "50%≤image coverage" holds (Step 107: NO), the controller 4 outputs control signals to the air-sending operation switching unit 341 to change the rotation speed of the fans 34 so that the speed of the air flow in the air circulating duct becomes 160 mm/sec, which is lower than the normal speed by 20% (Step S109). The controller 4 also outputs control signals to the heating operation switching unit 331 to change the temperature of the heater 33 to 49° C., which is lower than the normal degree by 1° C. (Step S109).

If the controller 4 determines that "10%<image coverage≤50%" holds (Step S106: YES), the controller 4 outputs control signals to the air-sending operation switching unit 341 to change the rotation speed of the fans 34 so that the speed of the air flow in the air circulating duct becomes 200 mm/sec, which is the normal speed (Step S110).

When finishing any of the actions in Step S108, S109, and S110, the controller 4 causes the head units 21 and so forth to start recording images on the basis of the job data (Step S111). That is, the controller 4 outputs the image data included in the job data and control signals to the head drivers 214 to cause the head drivers 214 to output driving signals to the recording heads 211 at appropriate timings according to the circling movement of the intermediate transfer belt 31. The head units 21 (the recording heads 211) jet ink from the nozzles 213 to the outer circumferential surface 31*a* of the intermediate transfer belt 31, thereby forming primary images on the outer circumferential surface 31*a* with the ink having landed thereon accordingly. Meanwhile, the controller 4 feeds recording media M to the transferring roller 324 and drives the intermediate transfer belt 31 and the transferring roller 324 so that the image forming areas of the intermediate transfer belt 31 and the recording media M on the transferring roller 324 get into the nip part N at the same time. Thus, the primary images on the intermediate transfer belt 31 are transferred to the recording media M at the nip part N.

The controller 4 determines whether or not the recording of all the images related to the job data has finished (Step S112). If the controller 4 determines that the recording of all the images has not finished yet (Step S112: NO), the controller 4 performs the action in Step S112 again.

If the controller 4 determines that the recording of all the images has finished (Step S112: YES), the controller 4 outputs control signals to the roller driver 325 to stop driving the intermediate transfer belt 31 with the driving roller 321 (Step S113). The controller 4 also outputs control signals to the air-sending operation switching unit 341 to stop driving the fans 34 (Step S113). The controller 4 also outputs control signals to the heating operation switching unit 331 to stop the heating operation of the heater 33 (Step S113).

When finishing the action in Step S113, the controller 4 finishes the image recording process.

As described above, the inkjet recording apparatus 1 according to this embodiment includes: the ink jetter 2 that jets ink; and the transfer unit 3 that includes the ring-shaped intermediate transfer belt 31 and transfers, to a recording medium M, a primary image formed on the outer circumferential surface 31*a* of the intermediate transfer belt 31 with the ink that is jetted to land on the outer circumferential surface 31*a* by the ink jetter 2, the transfer unit 3 further including the heater 33 that heats the air in the internal space 31*c* of the intermediate transfer belt 31 enclosed by the inner circumferential surface 31*b* of the intermediate transfer belt 31, and the fans 34 that flow the air in the internal space 31*c*.

According to this configuration, the air in the internal space 31*c* is heated by the heater 33 and flowed by the fans 34. This allows the air in the internal space 31*c* to be heated to a uniform/approximately uniform temperature. That is, the air in the internal space 31*c* is restrained from having non-uniform temperature. The heat transmitted from the air in the internal space 31*c* to the intermediate transfer belt 31 heats the intermediate transfer belt 31 so as to have a uniform/approximately uniform temperature distribution. This restrains non-uniform viscosity of the ink having landed on the outer circumferential surface 31*a* of the intermediate transfer belt 31, and allows the ink to be transferred to the recording medium M more stably.

Furthermore, the fans 34 circulate the air in the internal space 31*c* along the inner circumferential surface 31*b*. This allows the air in the internal space 31*c* to flow in a continuous and stable manner.

Furthermore, the inkjet recording apparatus 1 includes the roller driver 325 as the intermediate transfer belt driver that causes the outer circumferential surface 31*a* of the intermediate transfer belt 31 to circle, wherein the fans 34 circulate the air in the internal space 31*c* in a direction counter to a direction in which the intermediate transfer belt 31 circles. This increases the relative speed between the air in the air circulating duct and the intermediate transfer belt 31, thereby increasing the heat transfer coefficient between the intermediate transfer belt 31 and the air (i.e. to easily transmit the heat from the air to the intermediate transfer belt 31). This reduces power consumption of the inkjet recording apparatus 1.

Furthermore, the inkjet recording apparatus 1 includes the controller 4 that controls operation of the fans 34 and causes the fans 34 to circulate the air in the internal space 31*c* at a flow speed based on a circling speed at which the intermediate transfer belt 31 circles. Furthermore, the controller 4 causes the fans 34 to circulate the air in the internal space 31*c* at the flow speed that yields a relative speed between the intermediate transfer belt 31 and the air in the internal space 31*c* equal to or higher than a predetermined reference relative speed.

This makes it possible to control the relative speed between the air in the air circulating duct and the intermediate transfer belt 31. For example, if the intermediate transfer belt 31 circles at a low circling speed, the controller 4 increases the speed of the air flow, thereby increasing the relative speed between the air in the air circulating duct and the intermediate transfer belt 31. This secures the relative speed required to heat the intermediate transfer belt 31 at a desired efficiency (relative speed equal to or higher than the reference relative speed).

Furthermore, the controller 4 causes the fans 34 to circulate the air in the internal space 31*c* at a flow speed based on a ratio of parts covered by the ink of image forming areas on which primary images are formed on the outer circumferential surface 31*a* to the whole image forming areas.

Furthermore, the controller 4 controls the temperature of the heater 33 based on the ratio of the parts covered by the ink of the image forming areas on the outer circumferential surface 31*a* to the whole image forming areas.

This restrains the temperature of the intermediate transfer belt 31 from deviating from a desired temperature owing to heat transmission between the intermediate transfer belt 31 and the ink having landed on the intermediate transfer belt 31 in a case where there is a difference in temperature between the intermediate transfer belt 31 and the ink (e.g. in a case of using a phase-change ink that is jetted in a sol phase at a high temperature).

Furthermore, the ink jetter 2 is provided at a position where the ink jetting surfaces 212 from which the ink is jetted face the outer circumferential surface 31*a* of the intermediate transfer belt 31, and the fans 34 are provided in a region that does not overlap the ink jetting surfaces 212 as seen in a direction perpendicular to a portion of the outer circumferential surface 31*a* facing the ink jetting surfaces 212. This restrains changes of the distance between the ink jetting surfaces 212 of the ink jetter 2 and the intermediate transfer belt 31 due to the vibrations caused by the operation of the fans 34 and transmitted to the intermediate transfer belt 31, thereby restraining decrease in quality of recorded images.

Furthermore, the transfer unit 3 includes the beam member 361 that blocks heat radiation from the heater 33 to the intermediate transfer belt 31. Because the beam member 361 restrains the heater 33 from heating a part of the intermediate transfer belt 31 close to the heater 33, the intermediate transfer belt 31 is heated so as to have a uniform/approximately uniform temperature distribution.

Furthermore, the transfer unit 3 includes the outer panels 37 that are provided along a plane contacting one lateral end of the intermediate transfer belt 31 and a plane contacting the other lateral end of the intermediate transfer belt 31, respectively, and separate the internal space 31*c* from the external space. This restrains heat transmission between the internal space 31*c* and the external space, and makes it possible to heat the air in the internal space 31*c* to a uniform/approximately uniform temperature.

Furthermore, each of the outer panels 37 is provided with the heat insulator 371 on a surface contacting the external space. Furthermore, the transfer unit 3 includes the supporting members 38 that anchor the transfer unit 3 to the predetermined frame member 12, and each of the supporting members 38 is provided with the heat insulator 381 on a surface contacting the frame member 12. This restrains heat transmission between the transfer unit 3 and the outside of the transfer unit 3. Thus, the temperature in the internal space 31*c* of the intermediate transfer belt 31 and the temperature of the intermediate transfer belt 31 can be efficiently and stably adjusted to desired temperatures.

Furthermore, the ink jetter 2 jets the ink having a characteristic of changing its phases between gel and sol and heated to a temperature at which the ink becomes sol. When this kind of ink is used, non-uniform temperature of the intermediate transfer belt 31 tends to cause non-uniform viscosity of the ink having landed on the intermediate transfer belt 31, which leads to decrease in image quality. However, such decrease in image quality is efficiently restrained by flowing the air in the internal space 31*c* and making the temperature of the intermediate transfer belt 31 uniform/approximately uniform.

Although some embodiments according to the present invention have been described, the present invention is not limited to the above embodiments, and can be variously modified.

For example, although the fans 34 are provided at two air-sending positions in the air circulating duct in the above embodiment, the number of air-sending positions can be determined appropriately as long as the unevenness in speed in the air circulating duct is small enough. If, for example, the overall length of the air circulating duct is short or the air resistance in the air circulating duct is small, the fan(s) 34 may be provided at a single air-sending position.

Furthermore, it is not always necessary to provide a plurality of fans 34 in the width direction. For example, it is possible to narrow the air circulating duct in the width direction and provide a single fan 34 in the narrowed place.

Furthermore, although the fans 34 provided in the internal space 31*c* are cited as an example of the air mover in the above embodiment, the air mover is not limited to these. As the air mover, a mechanism that flows the air in the internal space 31*c* by sending air through a duct connecting the internal space 31*c* and the outside of the intermediate transfer belt 31 may be used.

Furthermore, the air mover is not necessary to circulate the air in the internal space 31*c*, but may stir the air in irregular directions.

Furthermore, although the heater 33 is covered by the beam member 361 as an example in the above embodiment, the present invention is not limited to this. For example, the heater 33 may be covered by: a plurality of bar-shaped beam members arranged across the outer panels 37 to fix the relative position of the outer panels 37; and blockers additionally provided between the beam members so as to block the heat radiation from the heater 33.

Furthermore, blockers may be omitted if non-uniformity in temperature of the intermediate transfer belt 31 due to non-uniform heat radiation from the heater 31 is small enough.

Furthermore, although the intermediate transfer belt 31, the beam member 361, and the outer panels 37 constitute the air circulating duct in the above embodiment, this is not intended to limit the present invention. The air circulating duct may be constituted by resin components or the like dedicated to the air circulating duct.

Furthermore, some parts of or all of the outer panels 37 may be omitted as long as the air in the internal space 31*c* can be heated and flowed efficiently.

Furthermore, although in the above embodiment the fans 34 are provided in regions that do not overlap the ink jetting surfaces 212 as seen in a direction perpendicular to a portion of the outer circumferential surface 31*a* facing the ink jetting surfaces 212, this is not intended to limit the present invention. The fans 34 may be provided in regions that overlap the ink jetting surfaces 212 as seen in the above direction if such overlap does not affect the jetting and landing of the ink.

Furthermore, the ink on the outer circumferential surface 31*a* of the intermediate transfer belt 31 may be tentatively cured before being transferred to the recording medium M. That is, the ink having landed on the outer circumferential surface 31*a* and become gel may be made to easily peel off from the outer circumferential surface 31*c* by ultraviolet irradiation that increases the viscosity of the ink to some extent. In such a case, the ultraviolet irradiator 51 may irradiate the ink on the outer circumferential surface 31*a* through the intermediate transfer belt 31 from the side where the inner circumferential surface 31*b* is provided, the intermediate transfer belt 31 being made of a material that transmits ultraviolet rays. This increases viscosity of the ink surface contacting the outer circumferential surface 31*a*, thereby making the ink easy to peel off. On the other hand, the viscosity of the other ink surface to contact a recording medium M is kept low, so that the adhesive strength of the ink to the recording medium M is secured.

Furthermore, a cleaner for cleaning the outer circumferential surface 31*a* of the intermediate transfer belt 31 may be provided between the nip part N and the driving roller 321 in the circling direction of the intermediate transfer belt 31. As a cleaning member used in the cleaner, fabric, nonwoven fabric, and a blade member can be used, for example. The cleaner may be configured to apply cleaning liquids for peeling off ink or stains to the outer circumferential surface 31*a* or the cleaning member.

Furthermore, there may be provided a plate-shaped member(s) covering, for example, a part(s) of the circling path of the outer circumferential surface 31*a* except a region to which the ink jetter 2 jets ink, a region that ultraviolet irradiator 51 irradiates to cure the ink tentatively as described above, and a region at which the cleaning member performs cleaning. This can reduce influence of an external temperature on the intermediate transfer belt 31 and heat the intermediate transfer belt 31 to a desired temperature more stably.

Furthermore, although the intermediate transfer belt 31 circles at different circling speeds in the warm-up operation and the image recording operation in the above embodiment as an example, the present invention is not limited to this. The intermediate transfer belt 31 may circle at the same speed in the warm-up operation and the image recording operation. In this case, it is preferable that the speed of the air flow (forced convection speed) in the warm-up operation be higher than the speed of the air flow in the image recording operation because the warm-up operation requires a larger amount of heat than the image recording operation, in which the intermediate transfer belt 31 is in a state of temperature equilibrium.

Furthermore, the type of ink is not limited to the ink described in the above embodiment. Instead of the phase-change ink, for example, an ink that remains liquid after being jetted may be used. A water-based ink made of water as a dispersion medium in which a coloring material, such as particles of a pigment, are dispersed may also be used.

Furthermore, although the intermediate transfer belt 31 is cited as an example of the intermediate transfer body in the above embodiment, the present invention is not limited to this. Various types of ring-shaped member having the outer circumferential surface on which ink lands may be used as the intermediate transfer body. For example, a cylindrical member having a fixed shape may be used as the intermediate transfer body.

Furthermore, although the inkjet recording apparatus 1 using the single-pass system is cited as an example in the above embodiment, the present invention may be applied to an inkjet recording apparatus that reciprocates the recording heads 211 to record images.

Although some embodiments of the present invention have been described and illustrated in detail, the disclosed embodiments are made for purposes of illustration and example only and not limitation. The scope of the present invention includes the scope of the present invention described in the scope of claims and the scope of their equivalents.

The entire disclosure of Japanese Patent Application No. 2018-204600 filed on Oct. 31, 2018 is incorporated herein by reference in its entirety.

What is claimed is:

1. An inkjet recording apparatus comprising:

an ink jetter that jets ink;

a transfer unit that includes a ring-shaped intermediate transfer body and transfers, to a recording medium, a primary image formed on an outer circumferential surface of the intermediate transfer body with the ink that is jetted to land on the outer circumferential surface by the ink jetter, the transfer unit further including a heater that heats air in an internal space of the intermediate transfer body enclosed by an inner circumferential surface of the intermediate transfer body, and an air mover that flows the air in the internal space, the air mover being located within the internal space; and a blocker that encircles the heater and that blocks heat radiation from the heater to the intermediate transfer body, at least a portion of the blocker being located between the heater and the ink jetter.

2. The inkjet recording apparatus according to claim 1, wherein the air mover circulates the air in the internal space along the inner circumferential surface.

3. The inkjet recording apparatus according to claim 2, comprising an intermediate transfer body driver that causes the outer circumferential surface of the intermediate transfer body to circle, wherein the air mover circulates the air in the internal space in a direction counter to a direction in which the intermediate transfer body circles.

4. The inkjet recording apparatus according to claim 2, comprising a hardware processor that controls operation of the air mover, wherein the hardware processor causes the air mover to circulate the air in the internal space at a flow speed based on a ratio of a part covered by the ink of an image forming area on which the primary image is formed on the outer circumferential surface to the image forming area.

5. The inkjet recording apparatus according to claim 2, comprising a hardware processor that controls a temperature of the heater based on a ratio of a part covered by the ink of an image forming area on which the primary image is formed on the outer circumferential surface to the image forming area.

6. The inkjet recording apparatus according to claim 1, wherein the air mover is provided in the internal space, the ink jetter is provided at a position where an ink jetting surface from which the ink is jetted faces the outer circumferential surface of the intermediate transfer body, and the air mover is provided in a region that does not overlap the ink jetting surface as seen in a direction perpendicular to a portion of the outer circumferential surface facing the ink jetting surface.

7. The inkjet recording apparatus according to claim 1, comprising separators that are provided along a plane contacting one lateral end of the intermediate transfer body and a plane contacting the other lateral end of the intermediate transfer body, respectively, and separate the internal space from an external space.

8. The inkjet recording apparatus according to claim 7, wherein each of the separators is provided with a first heat insulator on a surface contacting the external space.

9. The inkjet recording apparatus according to claim 1, wherein the transfer unit includes an anchor that (i) anchors the transfer unit to a predetermined basement and (ii) is provided with a second heat insulator on a surface contacting the basement.

10. The inkjet recording apparatus according to claim 1, wherein the ink jetter jets the ink having a characteristic of changing phases thereof between gel and sol and heated to a temperature at which the ink becomes sol.

11. An inkjet recording apparatus comprising:

an ink jetter that jets ink;

a transfer unit that includes a ring-shaped intermediate transfer body and transfers, to a recording medium, a primary image formed on an outer circumferential surface of the intermediate transfer body with the ink that is jetted to land on the outer circumferential surface by the ink jetter, the transfer unit further including a heater that heats air in an internal space of the intermediate transfer body enclosed by an inner circumferential surface of the intermediate transfer body, and an air mover that circulates the air in the internal space;

an intermediate transfer body driver that causes the outer circumferential surface of the intermediate transfer body to circle; and a hardware processor that controls operation of the air mover, wherein the hardware processor causes the air mover to circulate the air in the internal space at a flow speed based on a circling speed at which the intermediate transfer body circles.

12. The inkjet recording apparatus according to claim 11, wherein the hardware processor causes the air mover to circulate the air in the internal space at the flow speed that yields a relative speed between the intermediate transfer body and the air in the internal space equal to or higher than a predetermined reference relative speed.

13. An inkjet recording apparatus comprising:

an ink jetter that jets ink;

a transfer unit that includes a ring-shaped intermediate transfer body and transfers, to a recording medium, a primary image formed on an outer circumferential surface of the intermediate transfer body with the ink that is jetted to land on the outer circumferential surface by the ink jetter, the transfer unit further including a heater that heats air in an internal space of the intermediate transfer body enclosed by an inner circumferential surface of the intermediate transfer body, and an air mover that flows the air in the internal space, the air mover being located within the internal space; and a blocker that blocks heat radiation from the heater to the intermediate transfer body, at least a portion of the blocker being located between the heater and the ink letter, wherein the air mover is configured to blow air in a blowing direction, and is oriented such that the blowing direction is parallel to a portion of the inner circumferential surface closest to the air mover.

14. The inkjet recording apparatus according to claim 13, wherein the air mover is oriented such that the blowing direction of the air mover is parallel to an outer surface of the blocker closest to the air mover.

* * * * *